US006028278A

United States Patent [19]

Fluman

[11] Patent Number: 6,028,278

[45] Date of Patent: Feb. 22, 2000

[54] NORMALLY CLOSED MEMBRANE SWITCH AND METHOD OF MANUFACTURE

[75] Inventor: Robin Fluman, Glendale, Ariz.

[73] Assignee: Interface Data Systems, Phoenix, Ariz.

[21] Appl. No.: 09/067,201

[22] Filed: Apr. 27, 1998

[51] Int. Cl.[7] ..... H01H 1/10; H01H 13/50

[52] U.S. Cl. ..... 200/512

[58] Field of Search ..... 200/5 A, 512–517, 200/86 R, 243; 29/622

[56] References Cited

U.S. PATENT DOCUMENTS

| | | | |
|---|---|---|---|
| 4,476,355 | 10/1984 | Mital | 200/5 A |
| 4,618,754 | 10/1986 | Gross | 200/512 |
| 4,703,139 | 10/1987 | Dunlap | 200/5 A X |
| 4,771,139 | 9/1988 | DeSmet | 200/5 A |
| 4,795,861 | 1/1989 | O'Rourke | 200/5 A |
| 4,916,275 | 4/1990 | Almond | 200/516 |
| 4,920,342 | 4/1990 | Gratke | 200/5 A X |
| 5,791,459 | 8/1998 | Hester | 200/512 |

*Primary Examiner*—J. R. Scott
*Attorney, Agent, or Firm*—Snell & Wilmer, L.L.P.

[57] ABSTRACT

A normally closed membrane switch is presented which includes a substrate having a cut out area or aperture, a pair of conductive pads located on opposite sides of the aperture, a conductive bridge positioned across the aperture and connecting the pair of conductive pads, and a pill member located on the conductive bridge. The normally closed switch is opened by applying a downward force on the pill member which causes the conductive bridge to flex below the conductive pads. The conductive bridge then pivots against the edges of the substrate which forms the aperture thereby lifting the ends of the conductive bridge off of the conductive pads and opening the switch.

16 Claims, 4 Drawing Sheets

NORMALLY CLOSED MEMBRANE SWITCH AND METHOD OF MANUFACTURE

FIELD OF THE INVENTION

The present invention generally relates to a membrane type electrical switch that is in a normally closed position. More particularly, the present invention is directed to a normally closed membrane switch having a conductive bridge located between two conductive pads and an open or cut out area located beneath the conductive bridge. When existing in this unaltered state, the conductive bridge connects the conductive pads thereby completing an electrical connection and forming a closed switch. However, when the conductive bridge is depressed, the underside of the conductive bridge pivots on the edges of the open or cut out area thereby lifting the conductive bridge off the conductive pads. This action causes the electrical contact to be broken and results in an open switch.

BACKGROUND OF THE INVENTION

Membrane switches are typically built as normally open switches. However, several normally closed switches do exist in the field of art. For example, U.S. Pat. No. 4,771,139 issued to DeSmet discloses an improved keyboard having a flexible metal cover, normally closed switches, and multiple throw switches. The normally closed switch described in DeSmet includes a non-conductive pellet which transmits the actuating force on a key or switch through a substrate on which the switch is mounted. The substrate includes a hole through which the pellet can extend. The pellet provides a means for communicating the actuating force of a key site through the substrate to a movable electrical contact which is normally closed. When the switch is pressed, it extends through an opening in the substrate and pushes the electrical contacts out of communication thereby breaking the electrical circuit of the switch. The switch configuration includes a leaf spring having first and second ends which are in communication with contacts that are located on the substrate. At least one end of the spring is fixed or soldered to its associated contact.

Further, U.S. Pat. No. 4,618,754 issued to Gross describes a switch with a pivotable rocker that is arranged in a normally closed configuration. The switch has a normally closed set of electrical contacts and a downward force applied to the switch pivots an elongated, flat rocker to open the normally closed contacts. Pivoting of the rocker is yieldably resisted by an overlaying resilient membrane which forcibly returns the rocker to its original position when the force is removed. However, the rocker in the normally closed switch in Gross is located immediately above an upper circuit board having a first set of spaced electrical contacts fixed on its upper surface and a lower circuit board having a second set of spaced electrical contacts fixed on its upper surface. The upper surface board is positioned over the lower circuit board and an aperture in the upper circuit board is aligned with the second set of electrical contacts. The rocker comprises first and second ends having electrical contacts located on the bottom of the rocker at each end. The rocker rests on the upper circuit board with its first contact end touching and electrically shorting together the first set of circuit board contacts while the rocker's second contact end is located slightly above the second set of circuit board contacts. Accordingly, the first set of circuit board contacts provides a normally closed switch configuration while the second set of circuit board contacts simultaneously provides a normally open switch configuration.

A second embodiment of a momentary membrane switch having both a normally open set of electrical contacts and a normally closed set of electrical contacts is also disclosed in the Gross patent. This second embodiment comprises a disk-shaped switch element and a circuit board having first and second sets of circuit board contacts. The disk-shaped switch element has a first switch contact located on a circular ridge projecting downwardly and outwardly from the periphery of the disk-shaped element and a second switch contact located on a shallow projection in the center of the switch element's underside. The switch is assembled such that the first switch contact touches and shorts together the first set of circuit board contacts and the second switch contact is aligned with, and spaced slightly above, the second set of circuit board contacts. Accordingly, the first switch contact and first set of circuit board contacts form a membrane switch which is in a normally closed position and the second switch contact and second set of circuit board contacts form a membrane switch which is in a normally open position. However, upon applying a downward force to the center of the disk-shaped switch element, the second switch contact touches and shorts together the second set of circuit board contacts while the circular ridge which contains the first switch contact on the switch element's underside deforms upwardly and away from the circuit board thereby lifting the first switch contact away from the first set of circuit board contacts to open that switch. Once again, as described with reference to the first switch embodiment disclosed in Gross, this switch includes a normally closed set of electrical contacts and a second set of contacts that are simultaneously in an open configuration.

As can be seen from the above descriptions of normally closed membrane switches that currently exist in the field of art, these membrane switches require additional elements and space requirements compared to switches having a normally open configuration in order to perform their function. Further, in that there are situations and circumstances in which a normally closed switch configuration is desired, there is a need for a simply constructed yet durable normally closed membrane switch which has all of the attributes of a membrane switch having a normally open configuration.

SUMMARY OF THE INVENTION

It is a principle object of the present invention to provide a membrane switch comprising a normally closed configuration.

It is another object of the present invention to provide a membrane switch comprising a normally closed configuration which has all of the attributes of a membrane switch configured in a normally open position.

It is yet another object of the present invention to provide a membrane switch having a normally closed configuration which comprises a minimum of excess elements in comparison with a membrane switch having a normally open configuration.

It is still another object of the present invention to provide a membrane switch having a normally closed configuration which is durable, easy to assemble, and cost efficient to manufacture.

In brief, the normally closed membrane switch of the present invention includes a substrate having at least one aperture and a pair of conductive pads located on the upper surface of the substrate at opposite sides of the aperture, a conductive bridge spanning across the aperture that having opposite ends that are in contact with the conductive pads, respectively, and at least one pill member located on the conductive bridge and positioned above the aperture. In an alternate embodiment, the normally closed membrane switch may comprise two pill members that are seated on the conductive bridge and located near opposite edges of the aperture, respectively. Further, a second bridge member may connect the two pill thereby providing a surface centered above the aperture for actuating a downward force on the conductive bridge spanning the aperture.

The objectives, features, and advantages of the present invention will become more apparent to those skilled in the art from the following more detailed description of the preferred embodiments of the invention made in conjunction with the accompanying drawings.

DETAILED DESCRIPTION OF THE PREFERRED EMBODIMENTS

Figure 1:
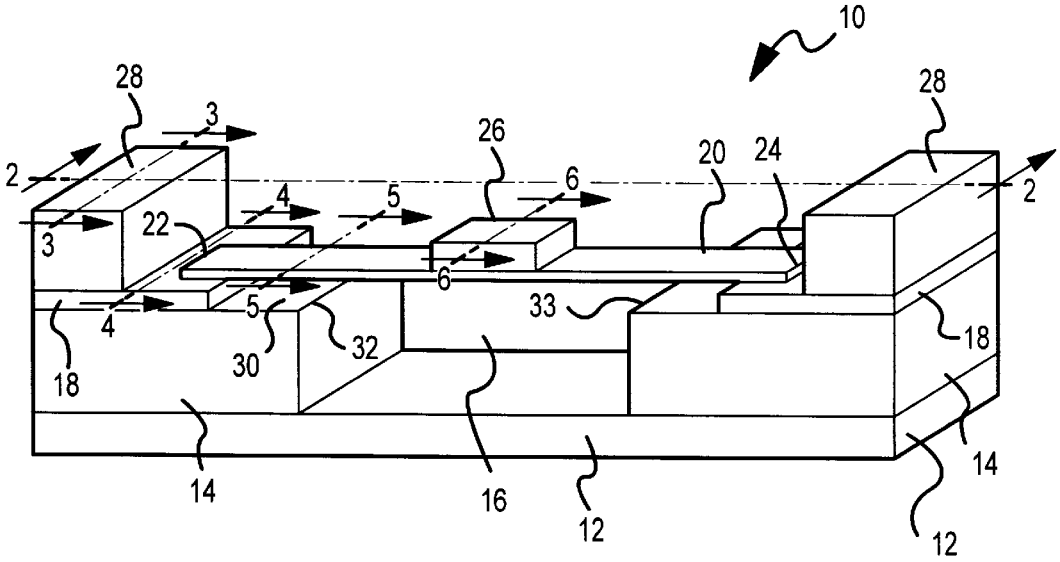
FIG. 1 is a perspective view of a first preferred embodiment of the normally closed membrane switch of the present invention.

A perspective view of the preferred embodiment of the normally closed membrane switch 10 of the present invention is shown in FIG. 1. The normally closed membrane switch 10 of the present invention is positioned on base substrate 12. The normally closed membrane switch 10 basically comprises a circuit substrate 14 having a depression, cut out area, or aperture 16, a pair of conductive pads 18, a conductive bridge 20, and a pill member 26. The circuit substrate 14 having aperture 16 is deposited on the base substrate 12. The circuit substrate 14 is typically composed of polyester film. The pair of conductive pads 18 are positioned on the surface of the circuit substrate 14 on opposite sides of the aperture 16. Further, the conductive bridge 20 comprises a first end 22 and a second end 24 and is positioned above and across the aperture 16 such that the first and second ends 22, 24 of the conductive bridge 20 are in contact with the conductive pads 18 that are positioned on opposite sides of the aperture 16, respectively. Finally, the pill member 26 is positioned on top of the conductive bridge 20 located over the aperture 16 in circuit substrate 14 so that a downward force can be actuated on the conductive bridge 20 thereby causing the ends 22, 24 of the conductive bridge 20 to lift off of conductive pads 18. The ends 22, 24 of the conductive bridge are lifted from the conductive pads 18 via a pivoting action which is further explained later with reference to FIG. 7.

The conductive pads 18 are preferably composed of silver thick film ink. Also, the conductive bridge 20 which spans across the top of aperture 16 is preferably composed of stainless steel. The pill member 26 may be composed of a variety of materials including, but not limited to, polycarbonate film and acrylic adhesive. A spacer substrate 28 is deposited on the upper surface 30 of the circuit substrate 14 and includes an aperture 16A which contains conductive bridge 20.

Figure 2:
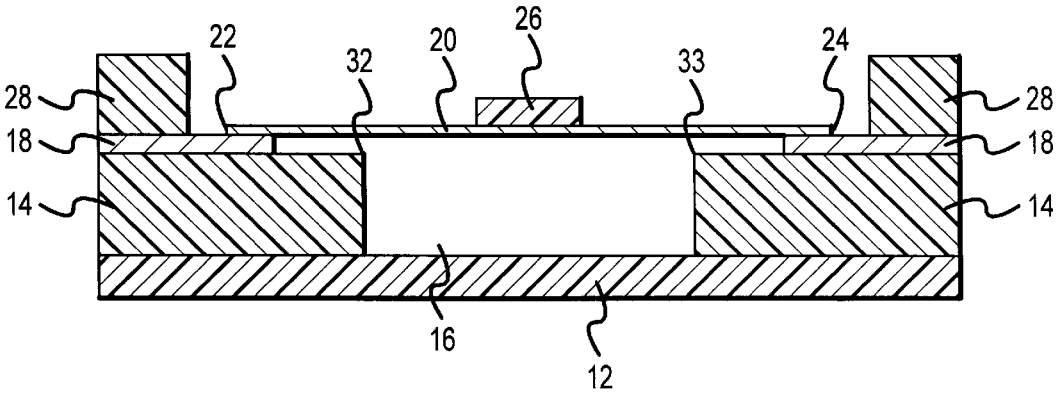
FIG. 2 is a cross-sectional view of the normally closed membrane switch of the present invention taken along line 2—2 of FIG. 1.
Figure 3:
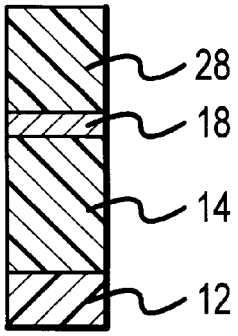
FIG. 3 is a cross-sectional view of the normally closed membrane switch of the present invention taken along line 3—3 of FIG. 1.
Figure 4:
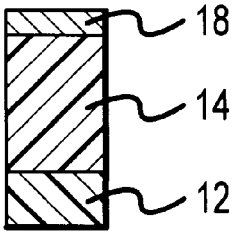
FIG. 4 is a cross-sectional view of the normally closed membrane switch taken along line 4—4 of FIG. 1.

Several cross sectional views of the preferred embodiment of the normally closed membrane switch 10 of the present invention are depicted in FIGS. 2–6. FIG. 2 shows a cross-sectional view of the normally closed membrane switch 10 taken along line 2—2 shown in FIG. 1. The same elements described in FIG. 1 are again shown in FIG. 2, namely the base substrate 12, the circuit substrate 14 having aperture 16, the pair of conductive pads 18, conductive bridge 20 having first and second ends 22,24, pill member 26, and spacer substrate 28 having aperture 16A. FIG. 2 also identifies first and second edges 32, 33 of the circuit substrate 14 that surround aperture 16 which function as pivot points when applying a downward force to the conductive bridge 20 by applying pressure to pill member 26. (See FIG. 7)

Figure 5:
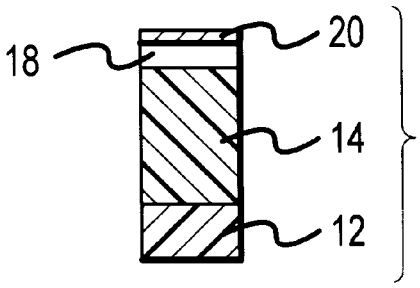
FIG. 5 is a cross-sectional view of the normally closed membrane switch taken along line 5—5 of FIG. 1.
Figure 6:
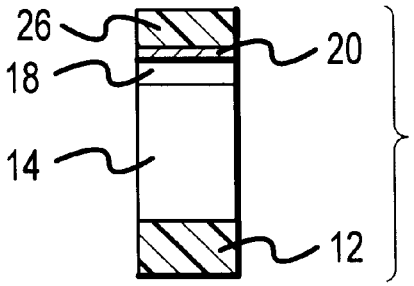
FIG. 6 is a cross-sectional view of the normally closed membrane switch taken along line 6—6 of FIG. 1.

FIGS. 3, 4, 5 and 6 are vertical cross-sectional views of the normally closed membrane switch 10 shown in FIG. 1 taken along lines 3—3, 4—4, 5—5, and 6—6, respectively. Note that FIGS. 5 and 6 show spaces where elements of the normally closed membrane switch 10 are not in contact with one another. These spaces facilitate pivoting of the conductive bridge 20 against edges 32, 33 so that the normally closed membrane switch 10 can be opened.

Figure 7:
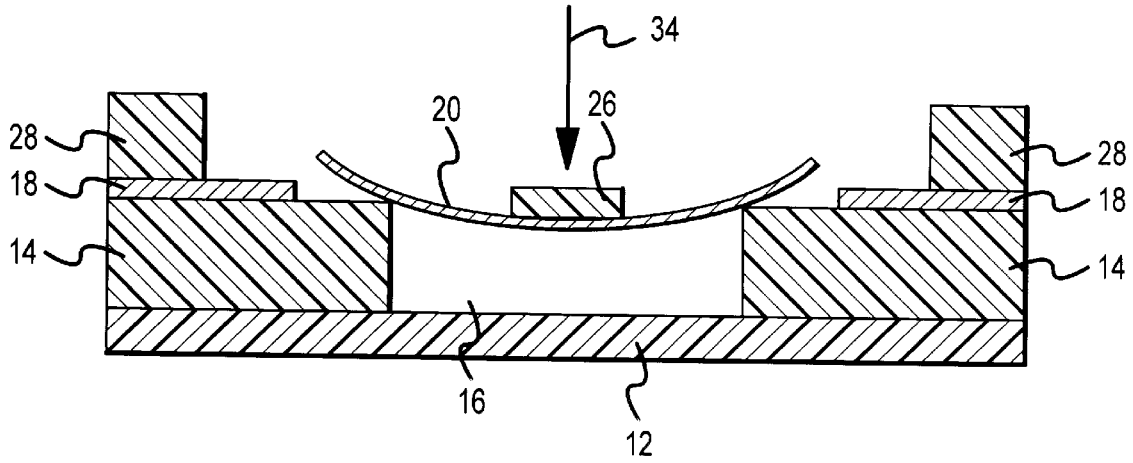
FIG. 7 is a cross-sectional view of the normally closed membrane switch of the present invention like that shown in FIG. 2 with the switch shown activated and in the open position.

Turning now to FIG. 7 there is shown a cross-sectional view of the normally closed membrane switch of the present invention like that shown in FIG. 2 with the switch shown activated and in the open position. In order to open the normally closed membrane switch 10 of the present invention, a downward force 34 is applied to the top of pill member 26. Downward pressure on pill member 26 causes the conductive bridge 20 to flex below the level of the conductive pads 18. As a result, the conductive bridge 20 pivots on the edges 32 of the circuit substrate 14 which define part of the perimeter of aperture 16. When the conductive bridge 20 pivots on the edges 32,33 of the circuit substrate 14 which are formed by aperture 16, the ends 22, 24 of the conductive bridge 20 lift off from the conductive pads 18 on which they rest and the switch is opened.

Figure 8:
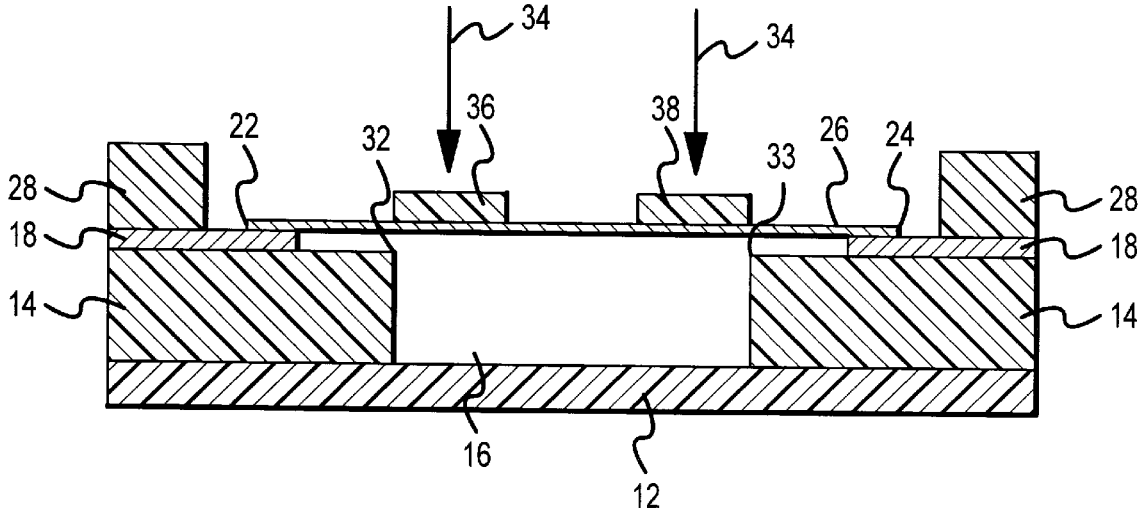
FIG. 8 is a lengthwise cross-sectional view of a second embodiment of the normally closed membrane switch of the present invention.

A lengthwise cross-sectional view of a second embodiment of the normally closed membrane switch of the present invention is illustrated in FIG. 8. FIG. 8 is identical to FIG. 2 with the exception that a pair of pill members 36,38 are located on top of the conductive bridge 20. The pair of first and second pill members 36,38 each have a first end 40 and a second end 42 and are positioned such that the first end 40 of first pill member 36 would lie adjacent to the first edge 32 of the circuit substrate 14 and the second end 42 of second pill member 38 would lie adjacent to the second edge 33 of the circuit substrate 14 if the first and second pill members 36,38 were not located above the circuit substrate 14. When opening the normally closed membrane switch shown in FIG. 8, a downward force 34 is applied simultaneously to both the first and second pill members 36,38 thereby causing the conductive bridge 20 to flex below the first level of the conductive pads 18. The conductive bridge then pivots simultaneously against first and second edges 32,33 of the circuit substrate 14 which results in the first and second ends 22,24 of the conductive bridge 20 lifting off of the conductive pads 18 thereby opening the switch.

Figure 9:
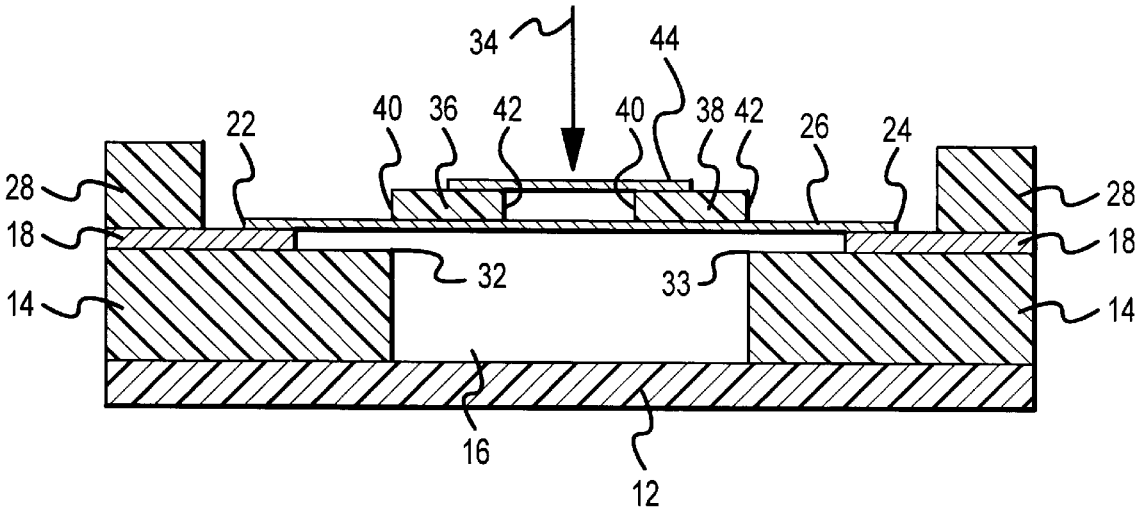
FIG. 9 is a lengthwise cross-sectional view of a third embodiment of the normally closed membrane switch of the present invention.

FIG. 9 shows a lengthwise cross-sectional view of a third embodiment of the normally closed membrane switch of the present invention. FIG. 9 is identical to FIG. 8 with the exception of a second bridge member 44 which is positioned across both of the first and second pill members 36,38. Accordingly, in order to open the normally closed membrane switch depicted in FIG. 9, a downward force 34 is applied to the middle of the second bridge member 44. This results in the conductive bridge 20 pivoting against the first and second edges 32,33 of the circuit substrate 14 which results in the first and second ends 22,24 of the conductive bridge lifting off the conductive pads 18. The addition of the second bridge member 44 serves to decrease the total amount of pressure exerted on the conductive bridge 20 as it pivots against the first and second edges 32,33 of the circuit substrate 14 thereby decreasing wear and tear on the conductive bridge 20 and increasing the useful life of the conductive bridge 20 and thereby increasing the longevity of the normally closed membrane switch.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

I claim:

1. A membrane switch having a normally closed configuration comprising:

a circuit substrate having at least one aperture contained therein and at least one pair of conductive pads located on an upper surface of said circuit substrate on opposite sides of the aperture;

a conductive bridge having first and second ends wherein said conductive bridge is positioned across said aperture such that the first and second ends of said conductive bridge are in contact with a top surface of said at least one pair of conductive pads, respectively; and at least one pill member located on a top surface of said conductive bridge above said aperture for actuating a downward force on said conductive bridge.

2. The membrane switch of claim 1 further comprising a base substrate located beneath said circuit substrate.

3. The membrane switch of claim 1 wherein the upper surface of said circuit substrate forms defined edges around a perimeter of said aperture.

4. The membrane switch of claim 1 wherein each of said at least one pair of conductive pads comprises at least one of a silver thick film ink and a carbon ink.

5. The membrane switch of claim 1 wherein each of said at least one pair of conductive pads comprises a material having an electrical contact fixed thereon.

6. The membrane switch of claim 1 wherein said conductive bridge comprises a flexible material.

7. The membrane switch of claim 6 wherein said flexible conductive bridge comprises stainless steel.

8. The membrane switch of claim 1 further comprising a spacer substrate positioned on the upper surface of said circuit substrate and abutting said at least one pair of conductive pads.

9. The membrane switch of claim 1 wherein said membrane switch comprises one pill member located at a center of said conductive bridge.

10. The membrane switch of claim 1 wherein said membrane switch comprises two pill members wherein each of said pill members is oppositely positioned on said conductive bridge above said aperture near each of said conductive pads, respectively, such that said pill members are disposed horizontally in relation to one another.

11. The membrane switch of claim 10 further comprising a second bridge member positioned across a top of and connecting, each of said two pill members.

12. A method for making a membrane switch having a normally closed configuration comprising the steps of:

a) providing a base substrate;

b) forming a layer of circuit substrate on a top surface of said base substrate;

c) removing a portion of said circuit substrate from the top surface of said base substrate to create an opening in said circuit substrate;

d) positioning at least one pair of conductive pads on a top surface of said circuit substrate on opposite sides of said opening;

e) placing a conductive bridge across said opening such that opposite ends of said conductive bridge make contact with said oppositely disposed conductive pads, respectively; and f) providing at least one pill member on top of said conductive bridge at a position over the opening in said circuit substrate for actuating a force on said conductive bridge.

13. The method of claim 12 further comprising the step of forming a spacer layer of substrate on top of said layer of circuit substrate subsequent to forming the layer of circuit substrate on the base substrate.

14. The method of claim 13 wherein said step of providing at least one pill member comprises the step of providing two pill members that are oppositely positioned on said conductive bridge above said opening near each of said conductive pads, respectively, such that said pill members are disposed horizontally in relation to one another.

15. The method of claim 14 further comprising the step of providing a second conductive bridge member and positioning it across a top surface of each of said two pill members.

16. A method for opening a normally closed membrane switch comprising the steps of:

a) applying a downward force to a pill member located on top of a conductive bridge connecting a pair of conductive pads separated by an aperture; and b) pivoting an underside of said conductive bridge against oppositely positioned top edges of said aperture thereby lifting opposite ends of said conductive bridge off of said conductive pads.

* * * * *